US006907652B1

(12) United States Patent
Heijnen

(10) Patent No.: US 6,907,652 B1
(45) Date of Patent: Jun. 21, 2005

(54) PIPE CONNECTING METHOD

(75) Inventor: Wilhelmus Hubertus Paulus Maria Heijnen, Nienhagan (DE)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/724,079

(22) Filed: Nov. 28, 2000

(30) Foreign Application Priority Data

Nov. 29, 1999 (EP) ..... 99309531

(51) Int. Cl.[7] ..... B23P 11/02

(52) U.S. Cl. ..... 29/447; 29/421.2; 29/552.1; 29/523; 285/382.4; 285/382.5; 166/207; 166/380

(58) Field of Search ..... 285/382.5, 397, 285/370, 21.2, 381.1, 381.2, 381.3, 381.4, 381.5, 382, 382.4; 166/380, 77.1, 207; 29/447, 421.2, 505, 521, 522.1, 523; 72/56, 58

(56) References Cited

U.S. PATENT DOCUMENTS

| | | | | | |
|---|---|---|---|---|---|
| 2,779,279 | A | * | 1/1957 | Maiwurm | 89/1.14 |
| 3,127,923 | A | * | 4/1964 | Cadwell | 72/56 |
| 3,131,467 | A | * | 5/1964 | Thaller et al. | 72/56 |
| 3,137,937 | A | * | 6/1964 | Cowan et al. | 228/108 |
| 3,140,537 | A | * | 7/1964 | Popoff | 228/108 |
| 3,206,845 | A | * | 9/1965 | Crump | 29/282 |
| 3,290,770 | A | | 12/1966 | Silverman et al. | |
| 3,434,194 | A | * | 3/1969 | Whittaker et al. | 29/421.2 |
| 3,555,831 | A | * | 1/1971 | Pogonowski | 405/227 |
| 3,661,004 | A | * | 5/1972 | Lee et al. | 72/56 |
| 3,710,434 | A | * | 1/1973 | Daniels et al. | 228/106 |
| 3,720,069 | A | * | 3/1973 | Lockridge | 405/166 |
| 4,052,861 | A | * | 10/1977 | Malone et al. | 405/224.2 |
| 4,530,527 | A | * | 7/1985 | Holmberg | 285/382.4 |
| 4,585,374 | A | * | 4/1986 | Regalbuto et al. | 405/227 |
| 4,716,731 | A | * | 1/1988 | Sakai et al. | 60/527 |
| 4,768,275 | A | * | 9/1988 | Schmitz | 29/407.01 |
| 4,860,656 | A | | 8/1989 | Hardwick | |
| 5,038,994 | A | * | 8/1991 | Feldstein et al. | 228/2.5 |
| 5,131,689 | A | * | 7/1992 | Bates | 285/87 |
| 5,297,827 | A | * | 3/1994 | Choi | 285/351 |
| 5,662,362 | A | * | 9/1997 | Kapgan et al. | 285/381.1 |
| 5,687,995 | A | * | 11/1997 | Mori et al. | 285/21 |
| 6,021,850 | A | * | 2/2000 | Wood et al. | 166/380 |
| 6,053,992 | A | * | 4/2000 | Wu et al. | 148/402 |
| 6,457,532 | B1 | * | 10/2002 | Simpson | 166/380 |
| 6,568,471 | B1 | * | 5/2003 | Cook et al. | 166/177.4 |
| 6,637,110 | B2 | * | 10/2003 | Jee | 29/890.031 |

FOREIGN PATENT DOCUMENTS

| | | | |
|---|---|---|---|
| DE | 3407467 | 10/1984 | |
| DE | 3407457 | 1/1985 | |
| EP | 881354 A2 | 12/1998 | |
| GB | 2057320 | 1/1981 | |
| GB | 2057320 A | 1/1981 | |
| GB | 2106817 | 4/1983 | |
| GB | 2106817 A | 4/1983 | |
| SU | 1629463 A * | 2/1991 | B23K/20/08 |

OTHER PUBLICATIONS

Search Report dated Jun. 3, 2001.

* cited by examiner

*Primary Examiner*—Essama Omgba

(57) ABSTRACT

A method of connecting a first pipe to a second pipe having an end part fitting into an end part of the first pipe, comprising arranging the end part of the second pipe within the end part of the first pipe, arranging a sleeve of a deformable material between said end parts, and radially expanding the end part of the second pipe towards the end part of the first pipe so as to bias the sleeve between said end parts.

6 Claims, 1 Drawing Sheet

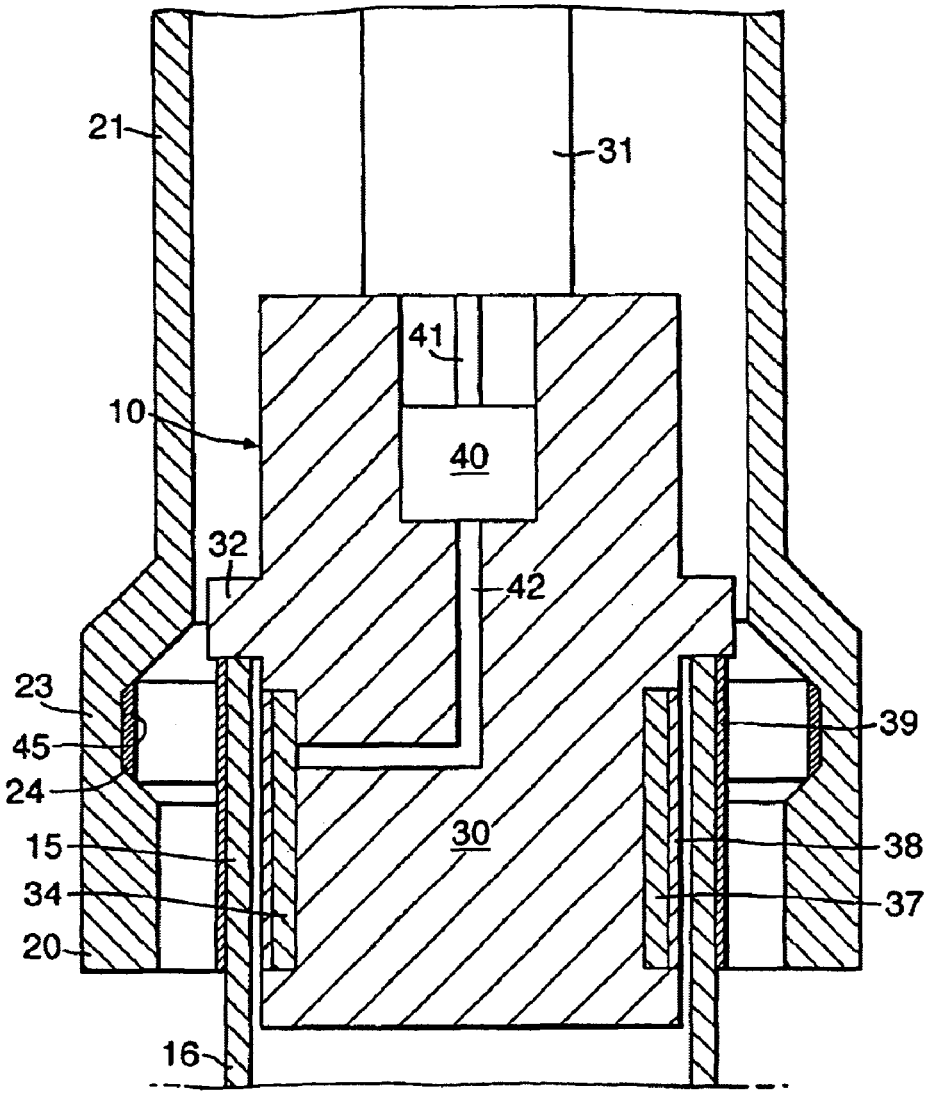
21
31
41
10
40
32
42
23
39
45
24
30
15
38
34
37
20
16

PIPE CONNECTING METHOD

The present invention relates to a method of connecting pipes. These pipes can be sections of a pipeline or well tubulars that are used in a well for producing hydrocarbons from an underground reservoir.

In particular the method is used in connection with interconnecting casing strings or liners. The casing string is a string of steel pipe sections that is used to line a borehole extending through an underground formation, and that is secured to the formation by means of cement. In a single well there may be two or more casing strings, wherein the upper end of the next casing string is hung off from the lower end of the preceding casing string. In order to be able to bring the next casing string into place, the outer diameter of the next casing string has to be smaller than the inner diameter of the preceding casing string. The next casing string may also be a so-called liner. In the specification the expression 'casing string' will also be used to refer to a liner.

Nowadays there are techniques that allow enlarging the diameter of a casing string when it is in the borehole. However, these techniques do not allow expanding the connection where the next casing string is hung off from the previous casing string.

Thus there is a need to provide a method that enables connecting a first pipe to a second pipe such that the inner diameter at the connection is not less than the inner diameter of the second pipe and that the pipes are adequately sealed at the connection.

In accordance with the invention there is provided a method of connecting a first pipe to a second pipe having an end part fitting into an end part of the first pipe, comprising a) arranging the end part of the second pipe within the end part of the first pipe;

b) arranging a sleeve of a deformable material between said end parts; and c) radially expanding the end part of the second pipe towards the end part of the first pipe so as to bias the sleeve between said end parts.

By biasing the sleeve of deformable material between the end parts an adequate seal is achieved between the pipes.

The sleeve can for example be made of a hard elastomer or a ductile metal, however it is preferred that the sleeve is made of a shape-memory alloy so that the sleeve is expandable upon heating of the sleeve to the transition temperature of the shape-memory alloy, and wherein the method further comprises:

d) after step c), heating the sleeve to the transition temperature of the shape-memory alloy thereby expanding the sleeve to form a metal-to-metal seal between said end parts.

Suitably two said shape-memory alloy sleeves are arranged concentrically between said end parts, one of the sleeves being connected to the outer surface of the end part of the second pipe, and the other sleeve being connected to the inner surface of the end part of the first pipe, and wherein after step c) each sleeve is heated to the transition temperature of the shape-memory alloy thereby expanding the sleeves to form a metal-to-metal seal between said end parts.

Preferably each sleeve is expandable by virtue of an increase of the wall thickness of the sleeve upon heating of the sleeve to the transition temperature of the shape-memory alloy.

The invention will now be described by way of example in more detail with reference to the accompanying drawing showing schematically a partial longitudinal section of the device 10 according to the present invention in a position in which it can connect the first end of a second pipe in the form of the top end 15 of a next casing string 16 to the second end of a first pipe in the form of the bottom end 20 a preceding casing string 21. The bottom end 20 is provided with an anvil section 23.

The casing strings 16 and 21 are arranged in a borehole (not shown) drilled in the underground formation, and the preceding casing string 21 is secured to the formation by means of cement (not shown). In order that the next casing string can be lowered through the preceding one, its outer diameter is smaller than the inner diameter of the preceding casing string 21.

The device 10 comprises a cylindrical body 30 provided with an annular shoulder 32 for positioning the device 10 at the top end 15 of the next casing string 16.

The device 10 is lowered into the preceding casing string 21 at the lower end of a drill string 31, of which the lower end is connected to the upper end of the cylindrical body 30.

The cylindrical body 30 is provided with an annular recess 34, in which annular recess 34 is arranged an explosive charge 37, which explosive charge 37 is covered by a protective sleeve 38. The cylindrical body 30 further comprises a device 40 for detonating the explosive charge 37. The device 40 for detonating the explosive charge is activated from surface by passing a signal through a cable 41 that extends to surface. The detonation is passed from the detonator 40 to the explosive charge 34 by transfer conduit 42.

During normal operation, the device 10 is brought into position as shown in the drawing, and the device 40 for detonating the explosive charge 37 is activated. The explosion of the explosive charge 37 causes the top end 15 of the next casing string 16 to deform. The anvil section 23 of the bottom end 20 of the preceding casing string 21 prevents further expansion of the top end 15, and thus the two casing strings are interconnected. After having made the connection the device 10 is pulled out of the well.

In order to improve the sealing of the connection, a sleeve of shape-memory alloy is provided on the outer surface of the first end of the second pipe and on the inner surface of anvil section, wherein the shape-memory alloy expands on heating to provide a metal-to-metal seal. Alternatively, the seal can also be a hard elastomeric part or a metal part.

The inner diameter of the anvil section can be so selected that the inner diameter of the second pipe (after expansion) is substantially equal to the inner diameter of the first pipe. Moreover, with known techniques the second pipe can be expanded over its full length, so that its inner diameter is not less than the inner diameter of the first pipe.

Thus the use of device according to the present invention allows a connection such that the inner diameter at the connection is substantial equal to the inner diameter of the first pipe.

What is claimed is:

1. A method of connecting a first pipe to a second pipe having an end part fitting into an end part of the first pipe, comprising:

a) arranging the end part of the second pipe within the end part of the first pipe;

b) arranging a sleeve of a deformable material between said end parts; and c) radially expanding the end part of the second pipe towards the end parts of the first pipe so as to bias the sleeve between said end parts wherein the first pipe is an upper wellbore casing secured in a formation and the second pipe is a lower wellbore casing; and wherein the sleeve is made of a shape-memory alloy so that the sleeve is expandable upon heating of the sleeve to the transition temperature of the shape-memory alloy, and wherein the method further comprises:

after step (c), heating the sleeve to the transition temperature of the shape-memory alloy thereby expanding the sleeve to form a metal-to-metal seal between said end parts.

2. The method of claim 1, wherein two said shape-memory alloy sleeves are arranged concentrically between said end parts, one of the sleeves being connected to the outer surface of the end part of the second pipe, and the other sleeve being connected to the inner surface of the end part of the first pipe, and wherein after step c) each sleeve is heated to the transition temperature of the shape-memory alloy thereby expanding the sleeves to form a metal-to-metal seal between said end parts.

3. The method of claim 2, wherein each sleeve is expandable by virtue of an increase of the wall thickness of the sleeve upon heating of the sleeve to the transition temperature of the shape-memory alloy.

4. The method of claim 3, wherein the inner surface of the end part of the first pipe is provided with an annular recess.

5. The method of claim 3, wherein step c) comprises installing a device provided with an explosive charge in the end part of the second pipe, and detonating the explosive charge.

6. The method of claim 5, wherein said device comprises a cylindrical body provided with an annular shoulder for positioning the device against the end part of the second pipe, and arranging the explosive charge in an annular recess.

* * * * *